US007669349B1

(12) United States Patent
Palmer et al.

(10) Patent No.: US 7,669,349 B1
(45) Date of Patent: Mar. 2, 2010

(54) METHOD SEPARATING VOLATILE COMPONENTS FROM FEED MATERIAL

(75) Inventors: Carl R. Palmer, Cary, NC (US); Michael J. McElwee, Lake Villa, IL (US); Gregg S. Meyers, Naples, FL (US)

(73) Assignee: **TD*X Associates LP**, Dallas, TX (US)

( * ) Notice: Subject to any disclaimer, the term of this patent is extended or adjusted under 35 U.S.C. 154(b) by 830 days.

(21) Appl. No.: 11/072,020

(22) Filed: Mar. 4, 2005

Related U.S. Application Data

(60) Provisional application No. 60/550,771, filed on Mar. 4, 2004.

(51) Int. Cl.
*F26B 11/00* (2006.01)

(52) U.S. Cl. ..... 34/381; 34/413; 210/770; 432/13; 432/69

(58) Field of Classification Search ..... 34/380, 34/381, 407, 413; 432/13, 69; 210/770
See application file for complete search history.

(56) References Cited

U.S. PATENT DOCUMENTS 1,571,877 A * 2/1926 McElroy ..... 48/203
1,731,474 A * 10/1929 Naugle ..... 502/5
1,778,515 A * 10/1930 Hampton ..... 208/425
1,866,203 A * 7/1932 Folliet et al. ..... 75/752
1,890,662 A * 12/1932 Greene ..... 432/98
1,988,541 A * 1/1935 Christensen ..... 432/14
2,081,421 A * 5/1937 Betterton et al. ..... 432/13
2,086,561 A * 7/1937 Koeppl ..... 202/86
2,226,532 A * 12/1940 Hawley et al. ..... 210/634
2,365,983 A * 12/1944 Vanderwerf ..... 110/194
2,429,980 A * 11/1947 Allinson ..... 208/127
2,735,787 A * 2/1956 Eastman et al. ..... 427/216
3,025,143 A * 3/1962 Huff ..... 422/159
3,047,473 A * 7/1962 Schmidt ..... 201/4
3,249,075 A * 5/1966 Nelson et al. ..... 110/343
3,400,465 A * 9/1968 Von Stroh ..... 34/443
3,511,599 A * 5/1970 Suriani ..... 210/711
3,591,449 A * 7/1971 Hess et al. ..... 162/30.1
3,595,742 A * 7/1971 Hess et al. ..... 162/30.1
3,607,062 A * 9/1971 Sudduth ..... 201/25
3,681,851 A * 8/1972 Fleming ..... 34/291
3,687,646 A * 8/1972 Brent et al. ..... 48/209
3,692,287 A * 9/1972 Kohl et al. ..... 106/751

(Continued)

FOREIGN PATENT DOCUMENTS

EP 0 155 022 B1 5/1988

(Continued)

OTHER PUBLICATIONS

"DVT series polyphase processors," datasheet [online]. Littleford Day, Inc., Florence, KY; Copyright 1995 [retrieved on Aug. 30, 2005]. Retrieved from the Internet:<URL:http://littleford.com>; 5 pgs. total.

(Continued)

*Primary Examiner*—Stephen M. Gravini
(74) *Attorney, Agent, or Firm*—Mueting Raasch & Gebhardt, P.A.

(57) ABSTRACT

The present invention provides methods and apparatus for the separation of volatile components from a feed material.

28 Claims, 4 Drawing Sheets

U.S. PATENT DOCUMENTS

| | | | | | |
|---|---|---|---|---|---|
| 3,729,298 | A | * | 4/1973 | Anderson | 48/111 |
| 3,831,377 | A | * | 8/1974 | Morin | 60/274 |
| 3,841,851 | A | * | 10/1974 | Kaiser | 48/111 |
| 3,940,237 | A | * | 2/1976 | Gonzalez et al. | 432/72 |
| 3,946,495 | A | * | 3/1976 | Osdor | 34/413 |
| 3,990,273 | A | * | 11/1976 | Scholten et al. | 68/18 R |
| 4,017,421 | A | * | 4/1977 | Othmer | 423/659 |
| 4,055,390 | A | * | 10/1977 | Young | 75/762 |
| 4,098,200 | A | | 7/1978 | Dauvergne | |
| 4,133,273 | A | | 1/1979 | Glennon | |
| 4,133,865 | A | * | 1/1979 | Calbeck | 423/106 |
| 4,140,066 | A | | 2/1979 | Rathjen et al. | |
| 4,140,478 | A | | 2/1979 | Kawakami et al. | |
| 4,167,909 | A | | 9/1979 | Dauvergne | |
| 4,171,265 | A | * | 10/1979 | Battigelli et al. | 210/737 |
| 4,177,575 | A | | 12/1979 | Brooks | |
| 4,203,863 | A | | 5/1980 | Knotik et al. | |
| 4,204,835 | A | * | 5/1980 | Porter | 432/58 |
| 4,208,251 | A | * | 6/1980 | Rasmussen | 201/14 |
| 4,230,053 | A | | 10/1980 | Deardorff et al. | |
| 4,280,415 | A | * | 7/1981 | Wirguin et al. | 110/224 |
| 4,295,972 | A | | 10/1981 | Kamei | |
| 4,301,750 | A | | 11/1981 | Fio Rito et al. | |
| 4,311,103 | A | | 1/1982 | Hirose | |
| 4,312,763 | A | * | 1/1982 | Shea, Jr. | 210/777 |
| 4,314,877 | A | | 2/1982 | Queiser et al. | |
| 4,331,088 | A | | 5/1982 | Gold | |
| 4,361,100 | A | | 11/1982 | Hinger | |
| 4,376,373 | A | * | 3/1983 | Weber et al. | 60/648 |
| 4,402,274 | A | | 9/1983 | Meenan et al. | |
| 4,403,948 | A | * | 9/1983 | Waldmann et al. | 432/1 |
| 4,419,185 | A | * | 12/1983 | Bowen et al. | 201/4 |
| 4,420,901 | A | | 12/1983 | Clarke | |
| 4,440,867 | A | * | 4/1984 | Sabherwal | 502/62 |
| 4,441,880 | A | | 4/1984 | Pownall et al. | |
| 4,451,231 | A | | 5/1984 | Murray | |
| 4,463,691 | A | | 8/1984 | Meenan et al. | |
| 4,465,556 | A | * | 8/1984 | Bowen et al. | 202/99 |
| 4,466,361 | A | | 8/1984 | Henery et al. | |
| 4,469,720 | A | | 9/1984 | Morris | |
| 4,481,135 | A | | 11/1984 | Aspart et al. | |
| 4,501,205 | A | * | 2/1985 | Funk | 110/347 |
| 4,507,127 | A | * | 3/1985 | Hirose | 48/89 |
| 4,543,190 | A | * | 9/1985 | Modell | 210/721 |
| 4,566,204 | A | | 1/1986 | Friesner et al. | |
| 4,583,470 | A | * | 4/1986 | Hirose | 110/346 |
| 4,585,463 | A | * | 4/1986 | Hirose | 48/111 |
| 4,606,283 | A | | 8/1986 | DesOrmeaux et al. | |
| 4,606,760 | A | * | 8/1986 | Fritz et al. | 75/10.19 |
| 4,606,830 | A | * | 8/1986 | Cleaver et al. | 210/750 |
| 4,656,020 | A | * | 4/1987 | Barber | 423/322 |
| 4,662,990 | A | * | 5/1987 | Bonanno | 159/20.1 |
| 4,675,129 | A | | 6/1987 | Baatz et al. | |
| 4,676,177 | A | * | 6/1987 | Engstrom | 110/345 |
| 4,698,136 | A | * | 10/1987 | El-Allawy | 203/11 |
| 4,699,721 | A | | 10/1987 | Meenan et al. | |
| 4,702,798 | A | * | 10/1987 | Bonanno | 159/47.1 |
| 4,715,811 | A | * | 12/1987 | Lawall | 432/58 |
| 4,738,206 | A | | 4/1988 | Noland | |
| 4,765,257 | A | * | 8/1988 | Abrishamian et al. | 588/320 |
| 4,782,625 | A | * | 11/1988 | Gerken et al. | 47/1.42 |
| 4,787,323 | A | * | 11/1988 | Beer et al. | 110/346 |
| 4,810,190 | A | * | 3/1989 | Fussl | 432/95 |
| 4,820,469 | A | * | 4/1989 | Walsh et al. | 264/506 |
| 4,823,712 | A | * | 4/1989 | Wormer | 110/245 |
| 4,829,911 | A | * | 5/1989 | Nielson | 110/234 |
| 4,864,942 | A | * | 9/1989 | Fochtman et al. | 110/226 |
| 4,901,654 | A | * | 2/1990 | Albertson et al. | 110/346 |
| 4,902,446 | A | | 2/1990 | Erbse et al. | |
| 4,951,417 | A | * | 8/1990 | Gerken et al. | 47/1.42 |
| 4,957,710 | A | * | 9/1990 | Nagai et al. | 422/171 |
| 4,977,839 | A | | 12/1990 | Fochtman et al. | |
| 4,988,289 | A | * | 1/1991 | Coucher | 432/103 |
| 5,059,404 | A | * | 10/1991 | Mansour et al. | 423/201 |
| 5,087,375 | A | | 2/1992 | Weinwurm | |
| 5,096,415 | A | * | 3/1992 | Coucher | 432/14 |
| 5,100,314 | A | * | 3/1992 | Rierson | 432/103 |
| 5,103,578 | A | | 4/1992 | Rickard | |
| 5,114,497 | A | | 5/1992 | Johnson et al. | |
| 5,117,771 | A | | 6/1992 | Summers | |
| 5,121,699 | A | | 6/1992 | Frank | |
| 5,123,364 | A | | 6/1992 | Gitman et al. | |
| 5,127,343 | A | | 7/1992 | O'Ham | |
| 5,152,233 | A | * | 10/1992 | Spisak | 110/240 |
| 5,176,087 | A | | 1/1993 | Noland et al. | |
| 5,191,154 | A | * | 3/1993 | Nagel | 588/314 |
| 5,191,155 | A | | 3/1993 | Driemel et al. | |
| 5,199,354 | A | | 4/1993 | Wood | |
| 5,224,432 | A | | 7/1993 | Milsap, III | |
| 5,225,048 | A | * | 7/1993 | Yuan | 203/1 |
| 5,228,803 | A | | 7/1993 | Crosby et al. | |
| 5,230,167 | A | | 7/1993 | Lahoda et al. | |
| 5,253,597 | A | * | 10/1993 | Swanstrom et al. | 110/346 |
| 5,269,906 | A | * | 12/1993 | Reynolds et al. | 208/13 |
| 5,279,637 | A | * | 1/1994 | Lynam et al. | 71/12 |
| 5,290,334 | A | * | 3/1994 | Alexander | 65/335 |
| 5,300,137 | A | | 4/1994 | Weyand et al. | |
| 5,333,558 | A | * | 8/1994 | Lees, Jr. | 110/346 |
| 5,365,864 | A | * | 11/1994 | Switzer | 110/235 |
| 5,370,067 | A | * | 12/1994 | Finet | 110/346 |
| 5,376,354 | A | * | 12/1994 | Fischer et al. | 423/659 |
| 5,377,708 | A | * | 1/1995 | Bergman et al. | 134/105 |
| 5,392,793 | A | * | 2/1995 | Molloy | 131/339 |
| 5,411,889 | A | * | 5/1995 | Hoots et al. | 436/6 |
| 5,415,681 | A | * | 5/1995 | Baker | 95/45 |
| 5,423,992 | A | * | 6/1995 | McMahon et al. | 210/764 |
| 5,428,906 | A | * | 7/1995 | Lynam et al. | 34/379 |
| 5,453,562 | A | | 9/1995 | Swanstrom et al. | |
| 5,458,739 | A | * | 10/1995 | Boucher et al. | 202/153 |
| 5,490,907 | A | | 2/1996 | Weinwurm et al. | |
| 5,501,161 | A | * | 3/1996 | Wanger et al. | 110/344 |
| 5,505,143 | A | * | 4/1996 | Nagel | 110/204 |
| 5,514,286 | A | | 5/1996 | Crosby | |
| 5,549,057 | A | * | 8/1996 | Favreau | 110/218 |
| 5,557,873 | A | * | 9/1996 | Lynam et al. | 34/379 |
| 5,578,102 | A | * | 11/1996 | Alexander | 65/27 |
| 5,579,705 | A | * | 12/1996 | Suzuki et al. | 110/185 |
| 5,585,532 | A | * | 12/1996 | Nagel | 423/210.5 |
| 5,611,476 | A | * | 3/1997 | Soderlund et al. | 228/42 |
| 5,615,626 | A | * | 4/1997 | Floyd et al. | 110/346 |
| 5,619,936 | A | * | 4/1997 | Veltmann | 110/345 |
| 5,626,249 | A | * | 5/1997 | Tylko | 219/121.59 |
| 5,628,969 | A | | 5/1997 | Aulbaugh et al. | |
| 5,640,010 | A | * | 6/1997 | Twerenbold | 250/281 |
| 5,662,050 | A | * | 9/1997 | Angelo et al. | 110/246 |
| 5,678,236 | A | * | 10/1997 | Macedo et al. | 588/11 |
| 5,746,987 | A | | 5/1998 | Aulbaugh et al. | |
| 5,788,481 | A | * | 8/1998 | Von Beckmann | 432/103 |
| 5,795,484 | A | * | 8/1998 | Greenwald, Sr. | 210/696 |
| 5,810,471 | A | * | 9/1998 | Nath et al. | 366/25 |
| 5,829,918 | A | * | 11/1998 | Chintis | 405/128.3 |
| 5,843,284 | A | * | 12/1998 | Waters et al. | 196/46.1 |
| 5,869,810 | A | * | 2/1999 | Reynolds et al. | 219/388 |
| 5,879,566 | A | * | 3/1999 | Snyder et al. | 210/771 |
| 5,891,249 | A | * | 4/1999 | Bieler et al. | 118/420 |
| 5,913,677 | A | * | 6/1999 | Von Beckmann | 432/13 |
| 5,927,969 | A | * | 7/1999 | Dover et al. | 432/103 |
| 5,944,034 | A | * | 8/1999 | McRae et al. | 134/25.4 |
| 5,955,135 | A | * | 9/1999 | Boucher et al. | 426/492 |
| 5,972,301 | A | * | 10/1999 | Linak et al. | 423/53 |
| 6,013,834 | A | * | 1/2000 | Colling | 560/245 |
| 6,112,675 | A | * | 9/2000 | Potter et al. | 110/229 |
| 6,131,571 | A | * | 10/2000 | Lampotang et al. | 128/204.21 |
| 6,143,136 | A | | 11/2000 | Aulbaugh et al. | |

| | | | | |
|---|---|---|---|---|
| 6,148,599 | A * | 11/2000 | McIntosh et al. | 60/781 |
| 6,165,251 | A * | 12/2000 | Lemieux et al. | 95/82 |
| 6,213,029 | B1 * | 4/2001 | Potter et al. | 110/229 |
| 6,213,030 | B1 * | 4/2001 | Robertson et al. | 110/246 |
| 6,299,774 | B1 * | 10/2001 | Ainsworth et al. | 210/603 |
| 6,358,375 | B1 * | 3/2002 | Schwob | 204/173 |
| 6,368,849 | B1 * | 4/2002 | Norddahl | 435/262 |
| 6,398,921 | B1 * | 6/2002 | Moraski | 204/157.43 |
| 6,569,332 | B2 * | 5/2003 | Ainsworth et al. | 210/603 |
| 6,604,558 | B2 * | 8/2003 | Sauer | 141/98 |
| 6,636,811 | B1 * | 10/2003 | Walte et al. | 702/24 |
| 6,692,642 | B2 * | 2/2004 | Josse et al. | 210/605 |
| 6,783,743 | B1 * | 8/2004 | Starner | 422/224 |
| 6,862,877 | B1 * | 3/2005 | James | 60/39.464 |
| 6,863,004 | B1 * | 3/2005 | Randall | 110/341 |
| 6,869,539 | B2 * | 3/2005 | Sheets | 210/747 |
| 6,932,853 | B2 * | 8/2005 | Bratina et al. | 75/401 |
| 6,941,879 | B2 * | 9/2005 | Hahn et al. | 110/341 |
| 7,008,459 | B1 * | 3/2006 | Fraas et al. | 48/86 R |
| 7,128,153 | B2 * | 10/2006 | Vinegar et al. | 166/285 |
| 7,175,696 | B2 * | 2/2007 | Zhou et al. | 95/117 |
| 7,179,379 | B2 * | 2/2007 | Appel et al. | 210/321.67 |
| 7,217,343 | B2 * | 5/2007 | Land | 203/1 |
| 7,389,639 | B2 * | 6/2008 | Michalakos et al. | 60/309 |
| 7,481,878 | B1 * | 1/2009 | Perez-Cordova | 106/745 |
| 2002/0079266 | A1 * | 6/2002 | Ainsworth et al. | 210/603 |
| 2002/0113017 | A1 * | 8/2002 | Sheets | 210/660 |
| 2003/0201225 | A1 * | 10/2003 | Josse et al. | 210/605 |
| 2004/0182294 | A1 * | 9/2004 | Hahn et al. | 110/347 |
| 2004/0188340 | A1 * | 9/2004 | Appel et al. | 210/321.68 |
| 2006/0163160 | A1 * | 7/2006 | Weiner et al. | 210/651 |
| 2007/0251433 | A1 * | 11/2007 | Rabiner | 110/235 |
| 2007/0256985 | A1 * | 11/2007 | Zhao et al. | 210/757 |
| 2008/0017552 | A1 * | 1/2008 | Wright et al. | 209/167 |
| 2008/0029460 | A1 * | 2/2008 | Wright et al. | 210/705 |
| 2008/0201980 | A1 * | 8/2008 | Bullinger et al. | 34/493 |
| 2008/0210538 | A1 * | 9/2008 | Clark | 202/131 |
| 2008/0213146 | A1 * | 9/2008 | Zauderer | 423/222 |
| 2009/0018668 | A1 * | 1/2009 | Galbraith | 623/23.65 |
| 2009/0062581 | A1 * | 3/2009 | Appel et al. | 585/241 |

FOREIGN PATENT DOCUMENTS

| | | |
|---|---|---|
| EP | 0 324 566 A2 | 7/1989 |
| EP | 0 324 566 A3 | 7/1989 |
| EP | 0 575 180 A1 | 12/1993 |
| WO | WO 97/14517 | 4/1997 |

OTHER PUBLICATIONS

"Rotary Cylindrical Vacuum Dryers," datasheet [online]. Paul O. Abbe—Talk to the Experts; Copyright 2004 Division of Aaron Engineered Process Equipment, Bensenville, IL. Retrieved on Mar. 2, 2005. Retrieved from the Internet:http://www.pauloabbe.com/productLines/vacuumDryersSystems/horizon talrotary/index.html, 2 pgs.

"U-MAX® Dryer," datasheet [online]. Processall, Incorporated, Cincinnati, OH; published May 29, 2003 [retrieved on Aug. 30, 2005]. Retrieved from the Internet:<URL:http://www.processall.com>; 6 pgs. total.

* cited by examiner

METHOD SEPARATING VOLATILE COMPONENTS FROM FEED MATERIAL

RELATED APPLICATIONS

The present application claims the benefit of U.S. Provisional Patent Application Ser. No. 60/550,771, filed Mar. 4, 2004, which is incorporated herein by reference in its entirety.

FIELD OF THE INVENTION

The present invention relates to methods and apparatus for separating volatile components from feed materials, eg., solids, radioactive material, etc.

BACKGROUND OF THE INVENTION

A variety of approaches are known in the art for separating volatile and semi-volatile organic compounds, as well as for separating mercury from soil and similar solids. For example, various methods and apparatus for thermally separating volatile components are known. At least one objective of these methods has been the removal of contaminants such that resulting solids could be managed without regard to the former contamination. This objective has been accomplished using both low temperature, fixed processing vessels, and also using high temperature rotating processing vessels.

However, known approaches have limitations that become increasingly significant when the volume of material requiring treatment is too small to justify large costly treatment systems. Simply making the equipment smaller, to reduce initial cost, yields the equally limiting feature of low processing rate or capacity. Furthermore, certain desirable separation processes can occur only at higher temperatures. Thus, the low treatment temperatures imposed by certain separation vessels that are heated using heat transfer oils prevent achievement of the separation. Additionally, it is often prohibitively expensive to rapidly achieve low contaminant levels at the lower temperatures provided by these vessels heated by heat transfer oils.

U.S. Pat. Nos. 5,253,597 and 5,453,562 (Swanstrom et al.) describe a batch process that operates under strong vacuum with heat from a conventional hot oil heating system. This approach imposes an upper temperature limitation of 600 degrees Fahrenheit (° F.) for the treated solids. This limitation results in the inability to treat compounds that must be heated to significantly higher temperatures to undergo a chemical reaction prior to separation, such as thermal reduction of mercury salts to elemental mercury, depolymerization of organic plastics, or thermolysis of cellulose. Also, low temperature gradients result from this temperature limitation during portions of the treatment that require significantly longer treatment times and reduce both the capacity and economic viability of the process. For example, treatment times using a process described in U.S. Pat. No. 5,253,597 and U.S. Pat. No. 5,453,562 extend for several days due to low mass transfer rates when residual contaminant levels approach the part per million level, resulting in high operating cost and inefficient operations. This limitation is attributable to the restricted operating temperature imposed by the hot oil heating system.

U.S. Pat. Nos. 5,628,969 (Aulbaugh et al.) and 5,514,286 (Crosby) teach approaches that use a rotatable vessel with a fixed internal filter. These apparatus are mechanically complex and cannot be operated in a semi-continuous mode because of the complexities of introducing materials to and removing them from the rotating vessel (e.g., while maintaining the seal to achieve high vacuum).

U.S. Pat. No. 5,490,907 (Weinwurm et al.) discloses a method for treating sludges in which valuable liquids are recovered from the sludges. This method requires the addition of a reagent powder to the thermal processor to form a high surface area semi-solid. The heating vessel is restricted, however, to a maximum temperature of 350° C., thus imposing the same limitations as the processes of U.S. Pat. Nos. 5,253,597 and 5,453,562.

Other separation processes are disclosed in U.S. Pat. Nos. 4,864,942 (Fochtman et al.) and 4,402,274 (Meenan et al.), which involve the heating of organically contaminated solids in a continuous thermal unit with condensation and recovery of the contaminants. These processes are operated strictly on a continuous basis and require elaborate material feed and removal systems. Also, these processes allow a significant quantity of solids to migrate into the gas treatment system. Substantial equipment is thus needed to remove and manage these solids. This result is imposed by the nature of a typical continuous separation process. Additionally, the apparatus used in these continuous separation processes cannot be sealed, thus cannot operate at high vacuum.

SUMMARY OF THE INVENTION

In view of the above, one exemplary object of one or more embodiments of the present invention is to provide a method and apparatus for thermal treatment of a variety of feed materials, such as solids and liquid wastes with or without suspended solids, at high efficiency and high temperature, to separate components of the feed materials such that the separated components can be managed in a significantly different fashion than the original, untreated feed material. Such method and apparatus are provided by the present invention as described herein.

In one aspect, the present invention provides a method for separating at least one volatile component from a feed material including the at least one volatile component, the method including: introducing the feed material into an interior cavity defined in a stationary processing vessel, the stationary processing vessel disposed within a furnace enclosure, wherein a heating space is provided between an outer wall of the stationary processing vessel and the furnace enclosure; heating the feed material in the interior cavity to volatilize the at least one volatile component without decomposing the at least one volatile component, wherein heating the feed material results in a volatilized component and processed solid and/or semi-solid material, and further wherein the feed material is heated to a temperature of at least about 675° F.; filtering and discharging the volatilized component from the stationary processing vessel; and removing the processed solid and/or semi-solid material from the stationary processing vessel.

The present invention includes methods for efficiently separating a variety of both radioactive and non-radioactive feed materials, as discussed in detail below. This provides a lower cost, high efficiency method of processing, e.g., contaminated waste materials, and the ability to handle separated materials in conventional, less expensive ways, where the pre-processed feed material either would be very expensive to dispose of, or may not have a conventional method of disposal at all. The terms "processed," "processing," "treatment," etc. of feed material, as used herein, is understood to mean, but is not limited to, separation of components of the feed material. "Processed," "processing," "treatment," etc., as used herein, may also refer to, e.g., initiation and maintenance of certain chemical reactions, preferably certain chemical reactions initiated and/or maintained by the addition of heat.

In a further embodiment, the present invention also provides an apparatus for separating at least one volatile component from feed material including the at least one volatile component. Such apparatus includes: a stationary processing vessel for use in processing feed material including at least one volatile component, wherein the stationary processing vessel includes at least an interior cavity, an inlet for receiving feed material into the interior cavity of the stationary processing vessel, a first outlet for discharging a volatilized component resulting from processing in the interior cavity of the stationary processing vessel, and a second outlet for use in removing solid and/or semi-solid material resulting from processing in the interior cavity of the stationary processing vessel; a heating apparatus operable to heat feed material within the stationary processing vessel to a temperature of at least about 675° F.; and a filter operable to remove particles having a nominal size less than about 40 micrometers (μm) from a volatilized component when discharging the volatilized component through the first outlet.

Apparatus of the present invention provide treatment of the desired feed material as disclosed in greater detail below. Further, various embodiments of apparatus of the present invention may additionally include components such as one or more pollution control devices, carbon adsorption filters, etc. as desired for a particular application and discussed in greater detail below. Such embodiments are understood to be within the scope of the present invention.

In yet a further embodiment, the present invention provides an apparatus for separating at least one volatile component from feed material including the at least one volatile component, wherein the apparatus includes: a stationary processing vessel for use in processing feed material including at least one volatile component, wherein the stationary processing vessel includes: a cylindrical body defining an interior cavity; an inlet for receiving the feed material into the interior cavity of the stationary processing vessel; a first outlet for discharging a volatilized component resulting from processing in the interior cavity of the stationary processing vessel; and a second outlet for use in removing solid and/or semi-solid material resulting from processing in the interior cavity of the stationary processing vessel; a furnace enclosure containing the stationary processing vessel, wherein a heating space is provided between the stationary processing vessel and the furnace enclosure; a rotating, shaft mounted mixing apparatus including at least one mixing element, the mixing apparatus disposed at least partially within the interior cavity of the stationary processing vessel, wherein at least one mixing element is operable to move feed material disposed within the interior cavity of the stationary processing vessel; a heating apparatus including at least one gas burner, wherein the heating apparatus is capable of heating feed material received in the interior cavity to a temperature of at least about 675° F.; and a filter capable of removing particulates having a nominal size less than about 40 μm from the volatilized component when discharging the volatilized component through the first outlet.

DESCRIPTION OF EMBODIMENTS

Figure 1:
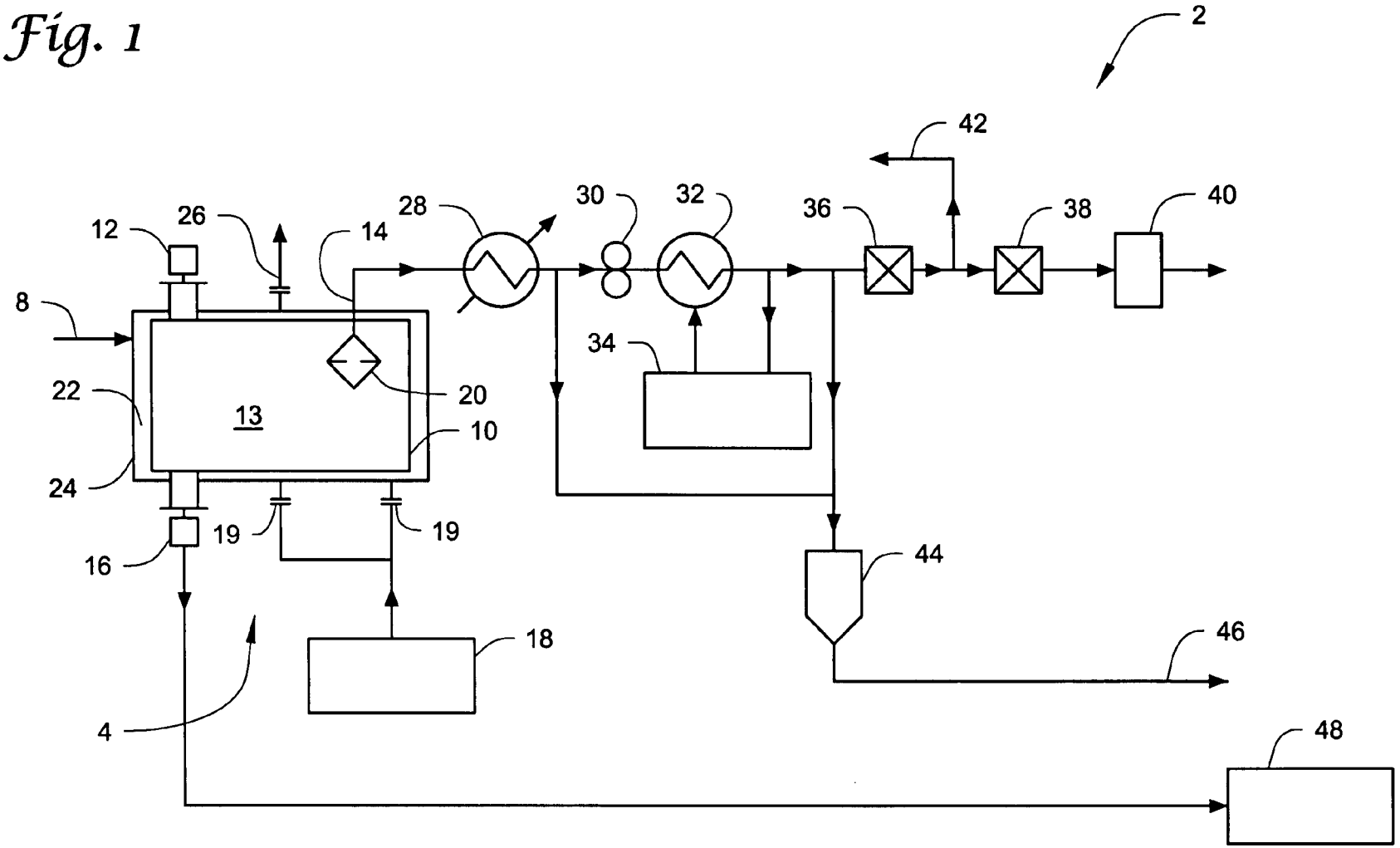
FIG. 1 is a schematic process flow diagram for one exemplary treatment system, presenting the relationship of various process components, including an exemplary separation apparatus according to the present invention.

The present invention provides methods and apparatus for the treatment of feed material (e.g., feed material including environmental contaminants), in the form of solids, sludges, liquids, etc. The feed material includes at least one volatile component, wherein a "volatile component" is understood to be a component that can be separated from feed material by the application of heat (e.g., sufficient heat is applied to feed material to permit phase separation of components). Volatile components separable by one or more embodiments of the present invention include aliphatic hydrocarbons, aromatic hydrocarbons, aliphatic hydrocarbons further including one or more halides, aromatic hydrocarbons further including one or more halides, polychlorinated biphenyls, organochlorine pesticides, polychlorinated dibenzo dioxins, mercury, mercury derivatives, etc.

Treating the feed material includes the performance of one or more processes, such as, for example, volatilizing and separating the volatile component from the remaining fraction, disposing of processed solid and/or semi-solid material, and condensing and recovering a condensable fraction of the volatilized component to provide a condensed liquid. It is understood that the terms "volatile component" and "volatilized component" refer to a single volatile component, or a combination of more than one volatile component.

One embodiment of the present invention includes separating components of the feed material, e.g., separating one or more volatile components from one or more non-volatile components, but does not necessarily include any other optional processes.

The present invention may be used in a batchwise manner for the processing of feed materials. For example, in a batch process an amount of feed material is provided in a stationary processing vessel, the vessel is sealed, and the amount of feed material provided to the stationary processing vessel is processed to remove the at least one volatile component therefrom. Following removal of the volatile component, any solid and/or semisolid material resulting from such processing of the amount of feed material provided to the stationary processing vessel is then discharged.

However, the methods and apparatus of the present invention are advantageously able to provide a semi-continuous method of treating feed material, such as, for example, in one embodiment wherein feed material is charged into a stationary processing vessel operating at negative pressure and subjected to elevated temperatures in the vessel to volatilize the volatile component. The volatilized component is removed from the stationary processing vessel through a high efficiency filter and may be directed to a gas treatment system. Further, for example, in the semi-continuous process (unlike the batch process), feeding material to the stationary processing vessel continues, and heat is added until the desired processing temperature is reached (e.g., the feed material is heated to the desired temperature), wherein processing continues until the residual, processed solid and/or semi-solid material with the volatile component removed has the desired characteristics (e.g., a certain quantity of constituents have been separated from the volatilized component). The residual processed material is then discharged from the vessel (e.g., when a certain quantity of solids is reached) and the cycle is repeated. The separated volatile component may be condensed and/or collected.

The semi-continuous processing of feed material in the present invention, in contrast with a batchwise process, provides the ability to introduce feed material requiring thermal treatment while the vessel is at or near full operating temperature and normal internal gas pressure and gas composition. This may be accomplished through, for example, sealed hoppers or containers and inlet and outlet solids valves. In other batch systems, such as disclosed in U.S. Pat. Nos. 5,253,597; 5,453,562; 5,514,286; 5,629,969; and 5,490,907, feeding at full temperature cannot be safely accomplished because of fire safety or emissions control concerns, requiring substantial periods of time during the treatment cycle to be devoted to cooling of the process vessel prior to introduction of the feed material. Eliminating this time dramatically increases the production capacity, as provided by the present invention.

Without being held to any particular theory, it is believed that the method and apparatus according to at least one embodiment of the present invention, wherein the feed material to be separated are brought to the temperatures in the stationary processing vessel as discussed further herein, unexpectedly provide the ability to accomplish certain separations and manage wastes that heretofore have been either impossible or economically impracticable to manage efficiently or to manage at all.

For example, a hazardous waste material in the form of a liquid including radioactive contaminants must be managed in a specific manner. These liquids can be a problematic material, particularly when the liquids include a small amount of radioactive material in a bulk aqueous or organic phase. Liquid waste evaporators transfer radioactivity over to the condensate. Incinerators destroy the liquids and have radioactive carryover to the gaseous pollution control devices. Mercury retorts and distillation units have radioactive carryover to the condensate. However, the methods and apparatus of the present invention provide the ability to efficiently separate the radioactive components, yielding an easily disposable liquid waste that includes essentially no radioactive material and, thus, can be managed in a manner substantially different from and more economically than the manner necessary for managing a radioactive liquid.

The method and apparatus according to any embodiment described herein surprisingly provide the ability to treat feed material, such as, but not limited to, radioactive liquid wastes, by thermally treating the feed material, vaporizing volatile components contained therein, and passing the volatilized components through a highly efficient particle filter, thus separating the volatilized component from dissolved or suspended solids that include the radioactive waste components. The separated radioactive material and other solids (e.g., inert solids) are recovered and managed by methods known in the art, and the non-radioactive liquids are recovered (e.g., volatilized components are condensed) and managed in a significantly different way from the original feed material.

Thus, the present methods and apparatus for treating radioactive liquid waste is particularly attractive and beneficial for those liquid wastes for which there is no currently permitted disposal facility. According to one embodiment of the present invention, such radioactive liquid waste is separated into a non-radioactive volatilized component (e.g., later condensed) and a solid radioactive waste for which disposal facilities are available.

The separation apparatus of the present invention may be part of a permanently installed treatment system. Conversely, the separation apparatus of the present invention may be provided as a portable apparatus by, for example, constructing the treatment system on steel frame skids or wheeled trailers to allow the apparatus to be relocated as desired.

Treatable Feed Materials

Many different types of feed materials can be treated by the methods and apparatus of the present invention. The materials and applications discussed below are exemplary of those advantageously treatable by the methods and apparatus of the present invention. It is, however, understood that the present invention is not limited by the following examples.

Industrial activities have, for example, resulted in the generation of soil, sludge and similar solids that are contaminated by organic chemicals and mercury. These contaminants according to the present methods can be separated from the solids, allowing for disposition of each contaminant according to the type of material it is. The present invention is beneficial for separation of both non-radioactive and radioactive contaminated feed material. Further, when the feed material also contains radioactive materials, the separation according to the present invention is particularly beneficial, because the recovered liquids may then typically be managed as non-radioactive material in less expensive disposal facilities or possibly even recycled as valuable products, such as to recover mercury.

Examples of material treatable by the methods and apparatus of the present invention include soil contaminated with oil, soil contaminated with organic material, soil contaminated with radioactive material, sediments, sludges, and geologic and man-made debris contaminated with volatile organic compounds, semi-volatile organic compounds, and mercury in its various forms. The present invention is also suitable for treating process filter cakes and sludges from oil drilling and refining that are contaminated by aliphatic, aromatic and polycyclic hydrocarbons, etc.

Furthermore, according to the present invention, a wide range of constituents including organic chemicals, mercury, etc., can be separated from solids and managed as contaminants of the bulk solid or liquid phase of the feed material. Chemical constituents typical of those treatable according to the present invention include, but are not limited to, chlorinated solvents; trichloroethene; perchloroethene; carbon tetrachloride; benzene; toluene; xylene; acetone; methyl isobutyl ketone (MIBK); aliphatic, aromatic, aldehyde and ketone solvents; aliphatic and aromatic hydrocarbon solvents; polychlorinated biphenyls; dioxin; pentachlorophenol; polychlorinated dibenzo dioxins and furans; polynuclear aromatic hydrocarbons (PAHs); hydrocarbons typical of oil (long chain aliphatic, aromatic and polycyclic); petroleum products; and chlorine and organochlorine type pesticides, herbicides, and similar compounds. Mercury contaminants include, but are not limited to, elemental mercury, and mercury compounds in the oxide, sulfide, nitrate, chloride, and similar salt forms.

Preferred feed materials treatable by methods and apparatus of the present invention are those that include at least one volatile component selected from the group of chlorinated solvents, aliphatic hydrocarbon solvents, aromatic hydrocarbon solvents, petroleum products, polychlorinated biphenyls, dioxin, chlorinated pesticides, chlorinated herbicides, mercury, mercury derivatives, and combinations thereof. Further, feed materials treatable by one or more embodiments of the present invention include at least one volatile component that is considered a hazardous waste material, wherein a hazardous waste material is understood to include waste material restricted from land disposal by law (e.g., regulations of the United States Environmental Protection Agency) and waste material requiring removal from soil or media by State and/or Federal law (e.g., State and/or Federal environmental laws).

Feed material including radioactive contaminants is advantageously treatable according to the present invention. Typical sources of these radioactive materials include, but are not limited to, all aspects of the nuclear fuel cycle and nuclear weapons manufacturing complex, such as source and byproduct materials (e.g., uranium, thorium); special nuclear materials (e.g., uranium, plutonium); low level radioactive waste (e.g., mixed fission products and activation products); and natural occurring and accelerator produced radioactive materials, etc.

The present invention may provide the separation of non-radioactive organic plastics and cellulose from radioactive materials. Radioactive wastes of this category of materials include, for example, spent organic ion exchange resin, contaminated plastic and cellulose trash (which is also commonly referred to as "Dry Active Waste"), and spent cellulose and plastic cartridge filter elements. Incinerators, glass melter vitrification units, steam reformers, pyrolysis units and similar destructive treatment processes have been and are currently used to manage these types of radioactive wastes. However, all of these units involve aggressive, high temperature operations that can be both expensive and potentially controversial to the public. Incinerators, for example, pose a problem in that they are highly regulated and, furthermore, may be difficult to use in the management of mercury, chlorinated organic or dioxin contaminated debris.

According to an embodiment of the present invention, radioactive waste organic plastics and cellulose are indirectly heated to a temperature high enough that the wastes undergo thermal degradation and desorption to the point that the majority of their mass is transferred to the carrier gas and is removed from the residual solids (e.g., radioactive metal elements or inorganic salt particulates are carried by the volatilized component and retained on the particle filter), but below the incineration temperatures at which destructive processes occur.

That is, it is believed that materials are heated until the solid material's basic organic materials decompose into smaller molecules that desorb and vaporize into a gas, while simultaneously removing these gases, until the residual solids have an ash-like characteristic with substantially less mass and volume than the original material. In the case of organic plastics and cellulose, it is preferred to first thermally degrade the bulk solids such that smaller molecules can then be desorbed and separated from the residual inert solids.

The residual solids remaining in the processing vessel have considerable less mass and volume, and are managed as a solid waste product in a manner considerably less expensive to dispose of than the mass and volume of the radioactive waste prior to treatment. Furthermore, when the radioactivity is retained in the treated solids, the gas treatment system used to treat the separated volatilized fraction is substantially simpler to design and operate.

Additionally, by performing the above treatment of radioactive waste in an indirectly heated thermal processing vessel, the gas environment can be carefully controlled to prevent oxidation and undesirable heat release in the stationary processing vessel. Nonetheless, separation of the volatile constituents can be performed with essentially the same mass change result as for a destructive process such as an incinerator. The volatile constituents are transferred to the gas stream and may later be condensed, oxidized or similarly treated separate from the radioactive solids.

For applications in which the feed material includes one or more of a radioactive solid material, an ion exchange resin, and a trash debris, the process according to at least one embodiment of the present invention may advantageously be used to pre-treat the feed material prior to further processing the residual solid and/or semi-solid material in a glass melter vitrification unit that is known in the art. Processing such untreated feed material in a glass melter vitrification unit is generally expected to severely compromise the operation of the unit, since when these wastes are treated in a conventional glass melter vitrification unit, the organic matter decomposes, releasing heat and placing a large gas volume loading in the glass melter vitrification unit and in downstream components. This severely limits the capacity of both the glass melter vitrification unit and the downstream components. Furthermore, decomposed organic matter often generates fixed carbon that dissolves in the molten glass, causing electrical conductivity changes in the glass melt, which leads to premature failure of the melter vessel.

However, by first treating the feed material by processing according to the present invention (e.g., removing organic chemicals from radioactive materials to provide a smaller mass of radioactive solids that are readily dissolved in the glass of a vitrification unit), the thermally processed solid and/or semi-solid material can be subsequently processed, as compared with processing of untreated feed material, at a capacity increased by a factor of about 3 to about 10 or more, without compromising the operation of the glass melter vitrification unit as described above.

A further application of an embodiment of the present invention is the thermal separation of liquids that have either dissolved or suspended particulate solids and/or radioactive materials contaminating them. By vaporizing the liquids and passing them through a heated high efficiency filter to retain the solids, the liquids can be condensed and recovered essentially free of the contaminants, providing efficient and economical management of the separated components. Liquid wastes to be treated are typically pumpable and can have solids content of less than about 1% and up to about 50% dissolved and/or suspended solid material. The dissolved and/or suspended material may be radioactive. Furthermore, the liquid may include, but is not limited to, water, organic chemicals, and mercury.

One exemplary advantage of the ability to efficiently separate suspended particulate solids present in feed material waste is that such untreated material is typically either unmanageable or extremely costly to manage. Examples of such liquids include, for example, laboratory solutions, equipment rinses, used chemicals from radioactive materials processing (e.g., Purex solvent), elemental mercury, waste oils or solvents, and concentrated liquid wastes from radioactive materials facilities (e.g., evaporator bottoms and laundry waste).

A further application for which an embodiment of the present invention may advantageously be used is for the separation of solid materials containing at least one of water, plastics, and cellulose to remove a significant fraction of these components. Examples of these solids include ion exchange resin, powdered ion exchange resin, trash type debris (e.g. plastic, cloth, paper, wood), filters, filter solids and sludges, etc. The result of such separation is both a solid residue of reduced mass and volume, and a liquid that can be managed separately from the solid.

These solid materials are heated in a stationary processing vessel according to one embodiment of the present invention to initially vaporize and remove water and absorbed/adsorbed liquids. The remaining solid and/or semisolid fraction may then be further heated to the point where the plastic depolymerizes and releases its organic constituents as a desorb-able liquid or a gas. The vaporized/gaseous components are passed through a high efficiency filter according to one embodiment of the present invention, removing substantially all radioactive constituents and minerals, wherein the fractions can be separately managed.

One will recognize that various pre- and/or post-separation components may be used in combination with the separation apparatus and in one or more various treatment system embodiments, and that the present invention is not limited to any particular components. Further characteristics of the generalized separation apparatus 4 are provided below. In addition, one or more configurations of an exemplary separation apparatus 100 are described with reference to FIGS. 2-4.

FIG. 1 is a schematic diagram of an exemplary treatment system 2 that includes a generalized separation apparatus 4 in combination with other typical process components according to one embodiment of the present invention. The separation apparatus 4 includes a stationary processing vessel 10 (e.g., a fixed horizontal vessel) positioned in a furnace enclosure 24. In one embodiment, the walls of the stationary processing vessel 10 are able to conduct heat provided in the heating space 22 using heat source 18 to treat feed material disposed in an interior cavity 13 of the stationary processing vessel 10. The furnace enclosure 24 (e.g., an insulated, metal walled housing) is operatively coupled to heat source 18 (e.g., one or more burners 19 that are capable of burning fuel such as heating oil, propane, or natural gas) capable of supplying a controlled amount of heat to the heating space 22 for transfer of heat to the stationary processing vessel 10.

The separation apparatus 4 further includes a filter 20 (e.g., directly mounted on top of the stationary processing vessel 10) for filtering a gas stream including volatilized materials and particulates exiting the stationary processing vessel 10 via a first outlet 14. The filter 20 is preferably a heated, high efficiency filter that is capable of essentially complete removal of solid particles from the gases that exit the stationary processing vessel 10 via first outlet 14.

Feed material, including at least one volatile component, to be processed is fed via the inlet 12 into the interior cavity 13 of stationary processing vessel 10 using any suitable feed process and apparatus to provide feed material via inlet 12 (e.g., feeding the feed material from totally enclosed, sealed hoppers, preferably sealed hoppers rated for full vacuum). In one embodiment, sealed hoppers are attached to inlet 12, which may be equipped with a vacuum valve when the stationary processing vessel 10 is at normal operating temperature, vacuum and gas environment, with one or more gas treatment components, for example components 28, 30, 32, 36, 38, and 40 discussed below, all operational in their normal mode. The vacuum valve of the inlet 12 is then opened, and feed material is fed into stationary processing vessel 10 (e.g., either as a full charge, or slowly by regulated discharge of solids) from the hopper, which can be equipped with a motorized bridge breaker or conveying elements to promote and regulate the discharge of feed material (e.g., solids) from the hopper. When the hopper is empty, the vacuum valve of the inlet 12 is closed and the hopper is removed and replaced with another full hopper. Alternatively, the hopper may be provided with a hinged cover that can be opened to accept more feed material at this point while the hopper is still attached to the vacuum valve of the inlet 12. In this way, material may be semi-continuously fed to the unit until the volumetric capacity of the stationary processing vessel 10 is reached.

Once the stationary processing vessel 10 is provided with feed material, the feed material is allowed to reach its treatment temperature, and the volatilized component is removed. The processed solid and/or semi-solid material resulting from the treatment process is then discharged through second outlet 16.

Any suitable discharge component may be employed. In one embodiment, a vacuum valve disposed on second outlet 16 is opened, and the processed solid and/or semi-solid material is dispensed (e.g., into an appropriate container or hopper 48).

After discharge, the conditions in the stationary processing vessel 10 are stabilized at an appropriate temperature, pressure and gas environment, and feed material is again introduced into the stationary processing vessel 10 through inlet 12. In addition, the stationary processing vessel 10 may include one or more optional outlets 26 as desired. Such optional outlets may be used, for example, for discharge of combustion products that do not mix with the contaminated feed material and, therefore, do not require air pollution control devices.

When the feed material to be processed includes liquids, processing is done as described above, with the following modifications. If the feed material is sufficiently liquid to be pumped through a nozzle, the feed material is so introduced into the stationary processing vessel 10. Furthermore, as such feed material would contain a smaller volumetric fraction of solids, feeding the material is anticipated to require a much longer time period, thus, such operation typically takes on characteristics more like a continuous process. However, the process is still considered to be semi-continuous, as the feed must be interrupted in order to achieve final solids treatment temperature and discharge of the treated solids.

It is possible that in some cases, both solid and liquid feed materials will be processed during a treatment cycle. In this case, the solid material may first be charged to the stationary processing vessel 10 (e.g., using a hopper), and then the liquids pumped into the stationary processing vessel 10 while it contains some solids at less than its volumetric capacity.

Thus, the present invention is adaptable to various contaminant treatment needs and requirements. For example, mass or volume reduction of feed material can be targeted, and a specification of waste output, such as density or fine particle content, can be achieved.

The stationary processing vessel 10 is typically operated under a partial or high vacuum, depending on the nature of the material being processed. The vacuum provides for containment of the hazardous solids, liquids and gases being processed. A partial or high vacuum also aids in movement of the volatilized components toward and through optional filters, gas treatment devices, and pollution control devices downstream of the stationary processing vessel 10. Inert gases such as nitrogen, if desired, may be fed to the stationary processing vessel 10 through a line 8 to aid in movement of the volatilized material and to prevent combustion of the material in the stationary processing vessel and/or in the downstream gas system (e.g., by controlling the oxygen concentration in stationary processing vessel 10).

Prevention of combustion of the feed materials and/or the volatilized components is managed through maintenance of the stationary processing vessel 10 sealed and under partial or high vacuum and/or in the presence of an inert gas such that the oxygen concentration (corrected to atmospheric pressure) is maintained typically at less than about 7%, and preferably less than about 5% by volume of the non-condensable gases. The internal pressure of the stationary processing vessel 10 is typically maintained at between about 360 mm Hg and about 600 mm Hg to suppress oxidation reactions inside the unit by substantially reducing the partial pressure of any oxygen that may enter the stationary processing vessel 10, for example, oxygen entering with the feed material via the inlet 12 or by in-leakage from any of the seals.

After the gases (e.g., volatilized component, inert gas, etc.) exit the stationary processing vessel 10 via the first outlet 14 and through the filter 20, they flow to a primary condenser 28 that cools the gases (e.g., to typically within about 50° F. of the ambient air temperature). This typically results in the condensation of a large fraction of water, semi-volatile organic compounds, and mercury present in the feed material that was processed. The gases are pulled via vacuum pump 30, and proceed to refrigerated condenser 32, cooled, for example, by a chilled water subsystem 34, where substantially all of the remaining condensable gases are removed. These condensable gases typically include a small amount of water, volatile organic compounds, and residual mercury, according to what was present in the processed feed material.

The residual gases are then filtered and discharged through appropriate air pollution control devices. For example, the residual gases may be flowed through a pre-filter 36, a HEPA filter 38 and a carbon adsorption vessel 40. Furthermore, depending upon the contaminants being processed and their cost of removal, cost of disposal, etc., the method and apparatus of the present invention may include in addition to or in place of any of the above pollution control devices, one or more of a catalytic oxidizer, a thermal oxidizer, a pressure swing adsorber, a membrane filter, or other such device. A condensate transfer tank 44, such as is known in the art, may be provided to collect liquid resulting from running the apparatus at low pressure/vacuum, with such liquid removed from the system via line 46.

Additionally, it is typically accepted to reclaim the heating value and control the non-condensable fraction of the residual gases prior to emission to the atmosphere, and methods of accomplishing this are known in the art. Also, if there is a significant volume of carrier gas resulting from the introduction of the inert gas into the process, approximately 95% of the inert gas is recycled through line 42 back to the stationary processing vessel 10. This recycling of the inert gas, if present, both reduces the load on the air pollution control devices, which in turn reduces their operating cost, and increases the overall removal efficiency of the process with respect to the air emissions.

The process can achieve little or no measurable emissions of particulate matter, radioactive particulate matter, PCBs, polychlorinated dibenzo dioxins and furans, and mercury. Emissions of volatile organic compounds are at a very low rate and well within current national standards for hazardous air pollutants.

Stationary Processing Vessel

The separation apparatus 4 of the present invention includes stationary processing vessel 10 that is placed within a heated furnace enclosure 24 for external (i.e., indirect) heating of materials placed within an interior cavity 13 of the stationary processing vessel 10. The stationary processing vessel 10 is preferably sealed and is provided with inlet 12 and second outlet 16 that can be opened and closed at various times during the treatment cycle to provide a way for introducing feed material to the stationary processing vessel 10 and a way for removing residual solids from the stationary processing vessel 10. The stationary processing vessel 10 is also provided with a first outlet 14 equipped with a high efficiency particle filter 20 to filter particulates from the gas stream including the volatilized component and to retain solid and/or semisolid materials within the stationary processing vessel 10. Further, the separation apparatus 4 includes an agitation or mixing apparatus (not shown in FIG. 1) operable to move feed material disposed within the vessel to promote heat and mass transfer, as well as volatilization of the volatile component in the feed material.

In one embodiment, the typical stationary processing vessel 10 includes a horizontal metal vessel fixed within a heated furnace enclosure 24 such that heat can be conducted into the feed material that is disposed within the stationary processing vessel 10. Any shape of stationary processing vessel 10 can be used in any embodiment of the present invention, such as square, rectangular, octagonal, polygonal, etc. However, a cylindrically shaped vessel is preferred. For example, a cylindrically shaped vessel has a higher strength characteristic for use under vacuum, it generally has a lower cost of manufacture, and allows ease of movement of feed materials disposed within interior cavity 13 of the stationary processing vessel 10 (e.g., material doesn't get embedded into corners of the vessel). Any size vessel appropriate for the feed materials being treated may be used. For example, a cylindrical vessel may have a length to diameter ratio of at least about 2:1, and up to about 5:1.

In one or more embodiments, the stationary processing vessel 10 has the capability to readily achieve a vessel wall temperature of at least about 1,400° F. using commonly available materials of construction. Appropriate materials for the construction of the stationary processing vessel 10 include carbon steel, stainless steel, INCONEL (Inco Alloys Welding Products Co., Newton, N.C.), etc., with thicknesses in the range of at least about 0.25 inches to about 0.5 inches. A typical and preferable construction material is 316L stainless steel, with a wall that has a dimension of about ⅜ inch thick, capable of achieving temperatures of at least about 1,600° F. It is possible to achieve maximum stationary processing vessel wall temperatures of at least about 1,800° F. using alloyed materials such INCONEL 800HT, or similar high temperature nickel alloys. The ability to achieve high wall temperatures is highly beneficial for increasing heat transfer rates and for achieving heating temperatures of feed material disposed within the interior cavity 13 of the stationary processing vessel 10 well in excess of about 600° F., and as high as about 1,400° F.

The vessel is preferably well sealed such that a full vacuum can be drawn on it as may at times be employed by the process, maintaining control over the internal gas pressure and composition and substantially preventing any material transfer between the stationary processing vessel 10 and the furnace enclosure 24. Seals used in the present invention are those commonly known in the art and include, for example, welds, flanges, packings, gaskets, etc.

In one or more embodiments, the inlet 12 and second outlet 16 (e.g., flanges of the vessel) may be equipped with vacuum valves that can be opened to pass solids through them and closed to maintain the desired pressure at the maximum operating temperature of the separation apparatus 4. These vacuum seals at the inlet and outlet allow for the stationary processing vessel 10 to be well sealed so that internal pressures can be reduced to nearly full vacuum with only minimal air in leakage. Well sealed vessels and vacuum valves are commonly available for jacketed vacuum dryers, also known as rotary vacuum dryers, such as are manufactured by Littleford-Day (Florence, Ky.) or Paul O. Abbe (Little Falls, N.J.). However, rotary vacuum dryers are typically heated by steam or hot oil through an external jacket, and as such the vessel is limited to providing heat to a maximum temperature of below about 650° F.

High heat transfer rates and high final solids temperatures, such as are achieved by the apparatus of the present invention, are achievable in rotary calciner thermal processing devices which are known in the art (e.g., the Bartlett-Snow device that is manufactured by Alstom Power Raymond (Lisle, Ill.). Such devices, however, being rotary devices provide for continuous processing only. The stationary processing vessel 10 of the present invention allows for batchwise or, advantageously, for semi-continuous processing of the feed material. Furthermore, the stationary aspect of the stationary processing vessel 10 of the present invention allows for the attachment of a high efficiency particle filter 20 to the first outlet 14, which is not practically achievable through the use of a rotary apparatus.

A further advantage of semi-continuous processing is that feed material may be introduced at any point during the treatment cycle, or even continuously, until the volumetric capacity of the stationary processing vessel 10 is met, thereby improving the dynamics of the solids heating and volatile matter removal, increasing the heating rate, and reducing the required size of gas treatment system components. The feeding of the feed material is subsequently terminated and the solids are allowed to attain the treatment temperature, after which they are discharged via the second outlet 16 as a treated batch.

Heating Apparatus

The separation apparatus 4 of the present invention also includes a heating apparatus for thermal treatment of feed materials disposed within the stationary processing vessel 10. Heating serves to volatilize the volatile components of the feed material. Additionally, the addition of heat may further serve to initiate certain chemical reactions, e.g., de-polymerization when processing certain plastic and cellulose materials, thermal reduction when processing mercury salts, etc. Furthermore, heating apparatus of the present invention not only provide the high level of heat used in the methods of the present invention, they additionally provide some control of the rate of the separations. For example, higher heat is believed to provide faster separation that is less costly than the same separation performed at a slower rate. It may, however, be desired to slow the rate of separation somewhat (e.g., reduce the vaporization rate) if the vapor pressure is elevated higher than desired. The present heating apparatus assist in provision of the desired rate of separation.

Components of the heating apparatus include the furnace enclosure 24 (e.g., an insulated furnace enclosure) at least partially surrounding, and preferably essentially completely surrounding, the stationary processing vessel 10. This configuration provides a heating space 22 intermediate the outer side of the wall (i.e., the "outer wall") of the stationary processing vessel 10 and the inner side of the furnace enclosure 24.

Typically, the furnace enclosure 24 is lined on the inner side with a refractory material, such as ceramic fiber board, refractory brick, or other high temperature insulative material, used in an amount sufficient to retain the desired amount of heat in the heating space 22. A typical insulative material used in one or more embodiments of the present invention is KAOWOOL ceramic fiber insulation (Thermal Ceramics, Augusta, Ga.). The ceramic fiber insulation is typically used in the furnace enclosure 24 in a thickness of at least about 2 inches and preferably at least about 4 inches. Additionally, the thickness of insulation used in the furnace enclosure 24 is typically no greater than about 10 inches and preferably no greater than about 8 inches.

The heating space can have any dimension, so long as adequate heat is provided to the wall of the stationary processing vessel 10 and, ultimately, to the feed materials disposed within the interior cavity 13 of the stationary processing vessel 10. Further, the dimension of the heating space 22 may be uniform or non-uniform. Preferably the dimension of the heating space 22 is substantially uniform and is at least about 3 inches from the inner side of the furnace enclosure 24 to the outer wall of the stationary processing vessel 10, and more preferably the heating space 22 is at least about 6 inches from the inner side of the furnace enclosure 24 to the outer wall of the stationary processing vessel 10. Further, while the heating space 22 can have any maximum dimension desired, an effective maximum dimension of the heating space is typically no greater than about 18 inches from the inner side of the furnace enclosure 24 to the outer wall of the stationary processing vessel 10, and more preferably the heating space 22 is no greater than about 12 inches from the inner side of the furnace enclosure 24 to the outer wall of the stationary processing vessel 10.

To provide the heat for processing of the feed materials, the atmosphere of the heating space 22 is heated to a temperature sufficient to heat the wall of the stationary processing vessel 10 and, consequently, indirectly heat the feed materials disposed within the interior cavity 13 of the stationary processing vessel 10 by conduction of heat through the wall of the stationary processing vessel 10 (it is understood that there is substantially no difference in temperature between the temperature of the outer wall of the stationary processing vessel 10 and the inner wall of the stationary processing vessel 10 that defines the interior cavity 13 of the stationary processing vessel). While the temperature of the heating space 22 may be substantially the same as the temperature to which the feed materials are heated, commonly there is some difference in temperature. Such difference may be controlled to some extent by the choice of materials and configuration of the stationary processing vessel 10, and may be limited by the desired vaporization rate of one or more of the volatile components present in the feed material. In one or more embodiments of the present invention, a temperature difference between the feed materials and the wall of the stationary processing vessel 10 of no greater than about 600° F., and preferably a temperature difference no greater than about 300° F. exists.

Additionally, while the temperature of the heating space 22 and the wall of the stationary processing vessel 10 may be substantially the same, in operation of the method and apparatus of the present invention there may be some difference between the temperature of the wall of the stationary processing vessel 10 and the temperature of the atmosphere of the heating space 22. In one or more embodiments of the present invention, a temperature difference between the wall of the stationary processing vessel 10 and the atmosphere of the heating space 22 is no greater than about 100° F., and preferably no greater than about 75° F.

Any appropriate method of providing indirect heating to the feed materials though heating of the heating space 22 may be used, provided the apparatus is operable to heat the feed material disposed within the interior cavity 13 of the stationary processing vessel 10 to a temperature of at least about 650° F., preferably to a temperature of at least about 675° F., more preferably, to a temperature of at least about 700° F., and even more preferably, to a temperature of at least about 800° F. While a suitable apparatus may be capable of heating feed material disposed within the interior cavity 13 of the stationary processing vessel 10 to a temperature as high as about 1,800° F., typical temperatures at which the feed material of the present invention are processed are no greater than about 1,400° F., preferably no greater than about 1,050° F., and more preferably no greater than about 925° F.

The heating space 22 is typically heated using external heat source 18 capable of heating the heating space 22 to desired temperatures. Such heating can be accomplished by electrical induction, a gas supply and gas burners, oil fired burners, etc.

One preferred heating apparatus of the present invention includes heating the heating space with, and controlling the heat in the heating space using one or more gas burners 19 connected to a gas source 18. The gas burners 19 are positioned for combustion directly into the heating space 22. However, ductwork may also be used to carry heated air into the space. Further, one or more other embodiments, for example, for very small units, or in specialized applications where combustion of a fuel is not allowable or advisable, the stationary processing vessel 10 may be heated using one or more electric resistance heaters.

The preferred operating temperatures of the present invention may have one or more of the following advantages over the economic and performance limiting hot oil heating systems currently known in the art, which only have the capability of heating the atmosphere proximate the heating unit to a maximum temperature of below 650° F. Higher temperature gradients and a higher final solids temperature achievable by the methods and apparatus of the present invention, typically provide more rapid treatment, and typically result in a higher production capacity. Also, certain chemical reactions, such as reduction of mercuric sulfide to elemental mercury, and depolymerization of organic plastic material, can be performed by the methods and apparatus of the present invention, as the activation temperature of such reactions, typically ranging from greater than 650° F. to over about 1,200° F., can readily be achieved.

Mixing Apparatus

As the processing vessel 10 of the present invention is stationary, the separation apparatus 4 also includes a way of moving or agitating the feed materials disposed within the interior cavity 13 of the stationary processing vessel 10 to promote heat and mass transfer as needed. Such functionality is provided by a mixing apparatus (not shown in FIG. 1).

A typical mixing apparatus is disposed either entirely, or at least partially, within the interior cavity 13 of the stationary processing vessel 10. Although any mixing apparatus may be suitable, the mixing apparatus preferably includes a plurality of mixing elements (e.g., blades, elements including plow-type or paddle-type attachments, etc.). The mixing apparatus may include, for example, a motor driven shaft having a plurality of plows, paddles, pugs, bars, ribbons, or other similar conventional tools mountable thereon and which are appropriate for agitating or mixing the feed material to be processed. The mixing apparatus may also be equipped with shaft seals to maintain the desired temperature and pressure of the separation apparatus 4.

One advantage of the mixing apparatus of the present invention is that it provides for adequate agitation and/or mixing of the feed material without needing to provide, e.g., radially positioned mechanical choppers such as are frequently provided on the vacuum dryers of the type manufactured by Littleford-Day in order to increase the rate of heat transfer. Provision of such radially positioned mechanical choppers incurs additional expense and the possibility of mechanical failure requiring maintenance that would be disruptive to the operation of the method and apparatus of the present invention in that radially positioned mechanical choppers typically require the use of an additional motor, and they further generally include a plurality of moving parts not present in the mixing apparatus of this invention.

Without being held to any particular theory, it is believed that it is not necessary to use, e.g., radially positioned mechanical choppers as present in the Littleford-Day apparatus because of the heat transfer rates achievable by the much higher surface wall temperatures of the present invention as compared with the limited wall temperature of the Littleford-Day apparatus.

Filter

The separation apparatus 4 also includes filter 20. In one or more embodiments, the volatilized component of the feed material are transferred, optionally with a carrier gas, through a high efficiency filter, to filter any solid particles being carried to the gas stream to be discharged through first outlet 14 to the gas treatment system. A preferred filter 20 of the present invention is substantially integral with the first outlet 14 of the stationary processing vessel 10. The filter 20 used is capable of filtering the gas stream including the volatilized component so as to substantially completely retain solids within the stationary processing vessel 10.

A preferred filter for use in the present invention is a high efficiency particle filter, preferably a High Efficiency Particle Arrestance (HEPA) filter, such as those available from Pall Corporation (East Hills, N.Y.) or Mott Corporation (Farmington, Conn.). Such filters are typically porous metal filters, although ceramic filters, such as filters including ceramic fibers, calcium silicate filters, filters including rigid, hard refractory material, etc., may alternatively be used. Ceramic filters have the advantage (e.g., although they are more costly than porous metal filters) of being more resistant to degradation, more inert to the chemistry of the present treatment processes, etc. Thus, ceramic filters typically have longer life spans than the porous metal filters.

Preferred filters of the present invention are able to filter particulates from the gas stream that includes the volatilized component of the feed material, wherein the filtered particulates have a size of about 40 micrometers (μm) or less. Preferably, filters of the present invention are able to filter out particulates having a size of about 30 μm or less, more preferably particulates having a size of about 20 μm or less, even more preferably particulates having a size of about 10 μm or less, and yet more preferably particulates having a size of about 1 μm or less.

It is advantageous in the methods of the present invention to heat the filter 20 as the gas stream including the volatilized component is filtered. By operation at an elevated temperature, it is believed that the filter is able to substantially remove particulate material from the volatilized phase in the presence of high boiling point vapors without the fouling of the filter media.

Heat may be provided to the filter 20 in any known manner, such as a heated jacket disposed around the filter 20, as long as the filter is able to be heated to a temperature of at least about 500° F., preferably to at least about 650° F., and heated to a temperature of no greater than about 1,000° F., preferably no greater than about 750° F. The filter 20 used should be selected to withstand the operating temperatures desired. Further, the filter 20 selected also should be essentially inert to the gaseous environment resulting from processing of the desired feed material.

Inert Gas/Vacuum System

The stationary processing vessel 10 of the present invention is preferably operable at low pressure (i.e., conditions substantially below atmospheric pressure) or essentially in a vacuum, optionally in conjunction with an inert gas. Preferably, the vessel is operated at a pressure of at least about 500 mm Hg absolute, more preferably at a pressure of at least about 100 mm Hg absolute. Thus, the stationary processing vessel 10 is preferably sealed so as to provide sufficient control over the internal environment of the system. Such control allows semi-continuous processing of the feed material and provides a driving force for gas flow out of the stationary processing vessel 10.

By providing low pressure operation, optionally with an inert gas, combustion of organic feed material being processed may be suppressed. Operation under high vacuum significantly reduces the partial pressure of oxygen in the stationary processing vessel, substantially preventing combustion of organic constituents through maintenance of a negative pressure within the stationary processing vessel and in the gas treatment system, preventing air in leakage into the system, and maintenance of a low internal oxygen level. The level of oxygen present in the stationary processing vessel 10 is maintained at or below about 10% oxygen, preferably maintained at or below about 7% oxygen, and more preferably maintained at or below about 5% oxygen.

Furthermore, a non-condensable, inert gas, such as nitrogen, etc., may assist in suppressing combustion of organic material during treatment by, for example, assisting in maintenance of the desired internal oxygen level. An inert gas, if used, is typically introduced into the system by way of the inert gas inlet 8 that provides the inert gas to the interior cavity 13 of the stationary processing vessel 10.

In an alternative embodiment, the method of the present invention may be performed substantially at atmospheric pressure, using the inert gas as the primary technique for maintaining the desired low internal oxygen level.

Treatment System

Certain embodiments of present invention preferably are employed within treatment system 2 that, among other features, provides for treatment of and control of air emissions from the separated gases emitted by the stationary processing vessel 10 of the separation apparatus 4. Preferably the separated, volatilized components are recovered and condensed for management as a liquid product, and the non-condensable material is prepared, such as by removing any unacceptable levels of air pollutants present in the inert carrier gas, for emission to the atmosphere.

Typical gas treatment systems 2 of the present invention include a primary condensing apparatus 28 to recover the separated volatile constituents, a vacuum pump 30 to reduce the internal pressure to substantially below atmospheric levels so as to provide gas movement from the stationary processing vessel 10 and a reduced oxygen partial pressure inside the stationary processing vessel 10, a secondary condensing apparatus 32 to recover further volatile matter, various optional filters 36, 38, 40, such as particle filters, carbon adsorption filters, etc., and various known air pollution control devices. The features selected for the gas treatment system 2 depend upon the feed material treated and the desired output of the volatilized components.

Optionally, a further embodiment of the invention includes a gas treatment system 2 whereby one or more of the condensation devices are replaced with a thermal oxidizer or similar device. Such thermal oxidizer or similar device provides elimination of an organic liquid residual stream by reaction of organic constituents in the gas phase to carbon dioxide, water, and mineral acids.

Figure 2:
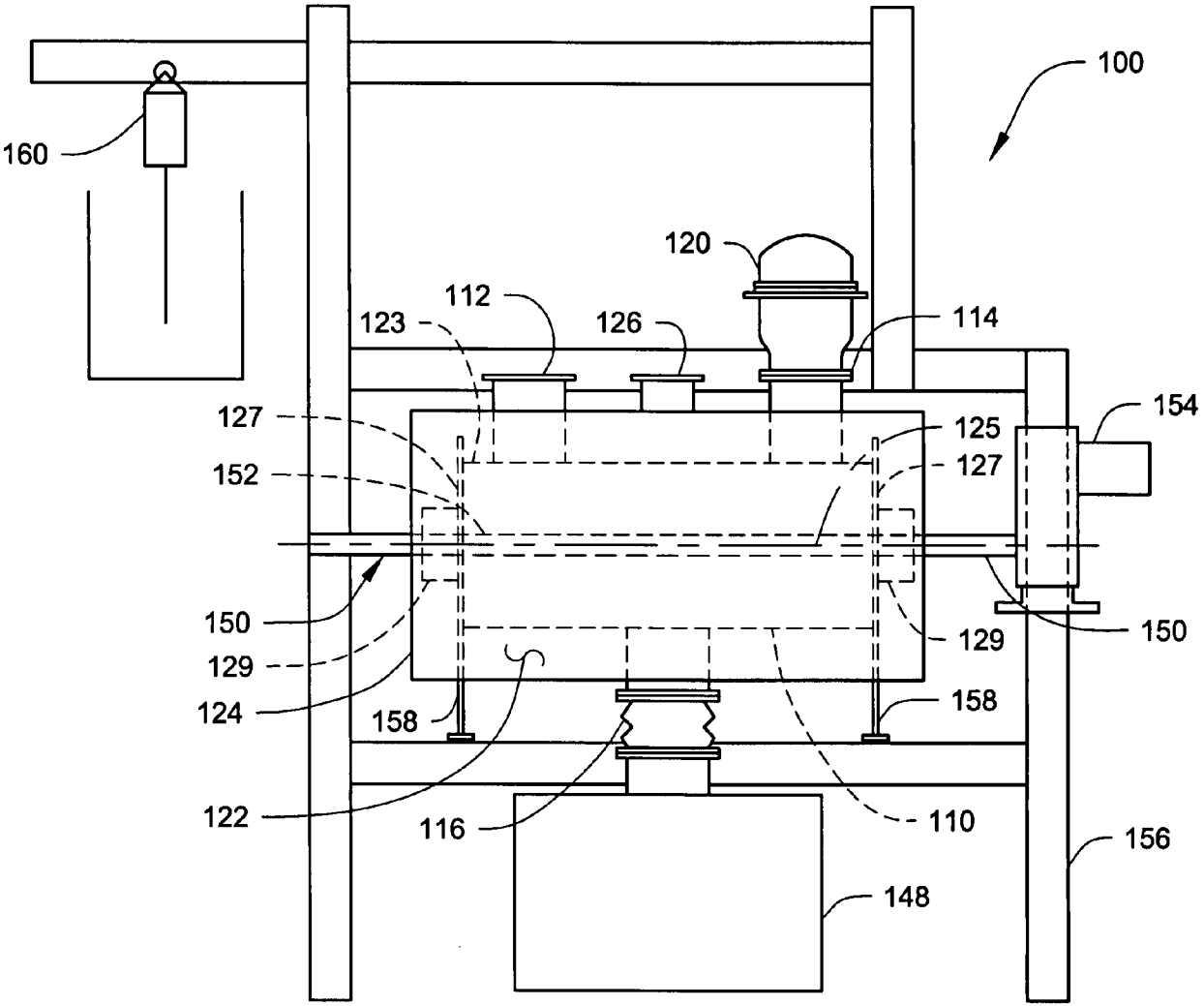
FIG. 2 shows one exemplary configuration of a separation apparatus of the present invention.
Figure 3:
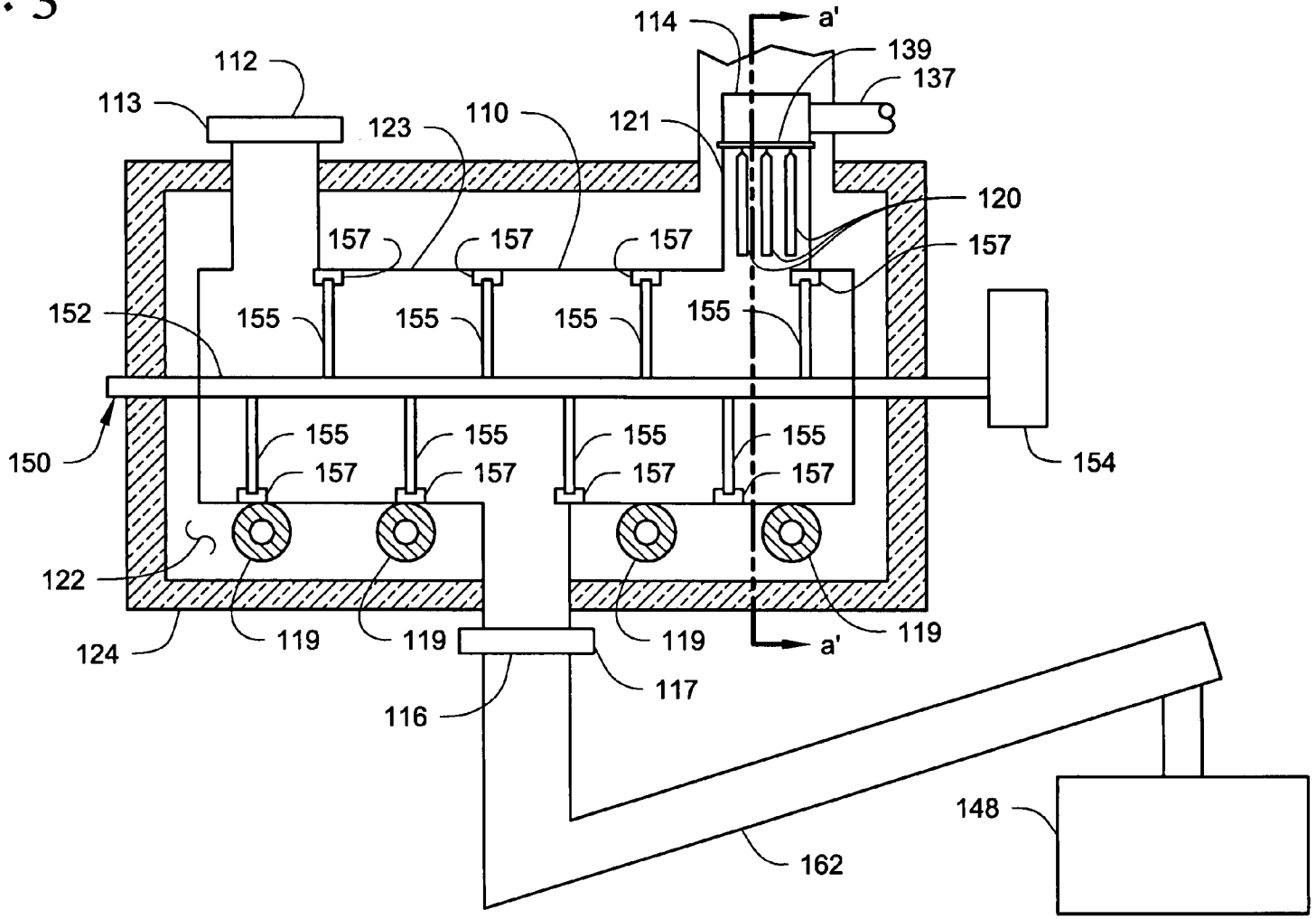
FIG. 3 is a cross-sectional view of the separation apparatus of FIG. 2 taken along the center of the separation apparatus.
Figure 4:
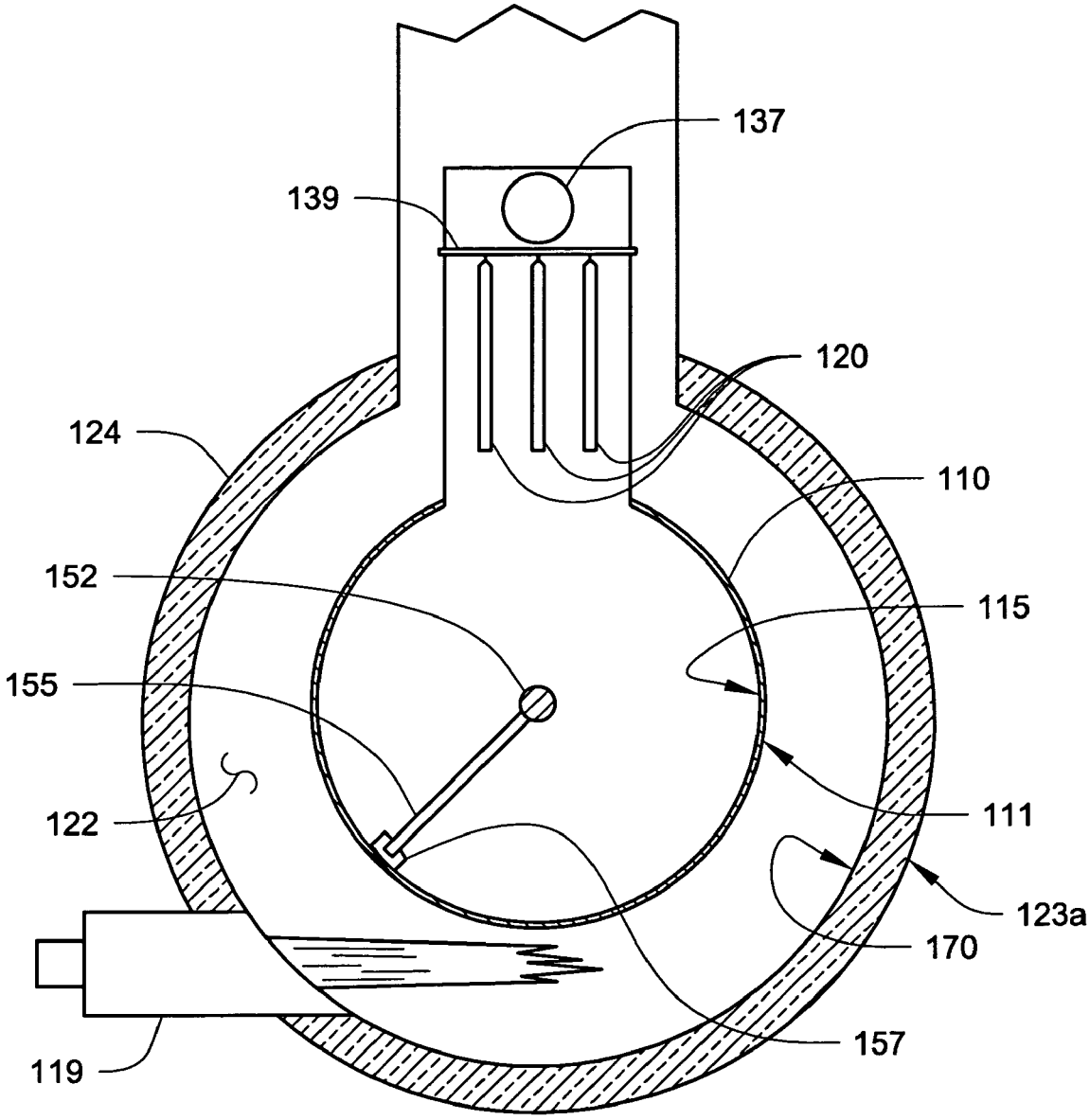
FIG. 4 is a cross-sectional view taken along a line a'-a' of the separation apparatus of FIG. 3.

FIG. 2 is a side view of the exemplary separation apparatus 100 according to the present invention. The separation apparatus 100 includes a furnace enclosure 124 in which a stationary processing vessel 110 is mounted. The components of the separation apparatus 100 are supported by a frame 156, and support system 158. FIG. 3 is a cross-sectional view of the separation apparatus 100 of FIG. 2, taken along the center of the separation apparatus 100. As shown in FIG. 3, the separation apparatus 100 includes the furnace enclosure 124, the stationary processing vessel 110, and further includes gas burners 119 and mixing apparatus 150, including a shaft 152 and mixing elements 155. FIG. 4 is a cross-sectional view taken along a line a'-a' of the separation apparatus of FIG. 3.

The stationary processing vessel 110 as depicted in FIG. 2 is supported by two or more steel supports 158 to a foundation or frame assembly 156. These supports 158 are designed to allow thermal expansion of the stationary processing vessel 110, as its length typically grows by several inches when it is heated.

The stationary processing vessel 110 may be constructed as horizontal cylinder body 123 having a length to diameter ratio ranging from about 2:1 to about 8:1. The cylinder body 123 lies along cylindrical axis 125 and has welded or flanged end plates 127 affixed thereto orthogonal to axis 125. One or more shaft assemblies, including one or more shafts 152 lying along axis 125 penetrate the end plates 127 and are provided with conventional shaft seals to allow sealing at high vacuum. Each end plate 127 also has a bearing assembly 129 to support, align, and allow rotation of the shaft 152.

Completely surrounding, and at a radial distance from the stationary processing vessel 110, is an insulated metal furnace enclosure 124. Typically, the end plates 127 of the stationary processing vessel 110 are enclosed within the furnace enclosure 124 so as to provide completely heated surfaces for the stationary processing vessel 110 and, as such, for heating the feed material contained therein for processing.

The furnace enclosure 124 is generally provided with one or more gas burners 119, as shown in FIG. 3, that heat the heating space 122 defined between the insulation that defines the inner wall 170 of the furnace enclosure 124 and the outer wall of the stationary processing vessel 110. The gas burners 119 are spaced along the length of the furnace enclosure 124 (e.g., to provide appropriate heat distribution therein). Alternatively, the heat may be provided, for example, by electric resistance heaters or any other appropriate heating apparatus, so long as the heating apparatus is capable of providing a temperature of about 250° F. to about 1,400° F. in the heating space 122.

The products of combustion in the furnace enclosure 124 may be vented from the upper quadrant of the furnace through one or more optional outlets 126. As the stationary processing vessel 110 typically is substantially completely sealed and the combustion products do not mix with the feed material in the stationary processing vessel 110, the products of combustion are normally emitted from the optional outlet 126 without need for air pollution control devices.

The stationary processing vessel 110 is provided with an inlet 112 for accepting the solid and/or liquid feed materials into the stationary processing vessel. The inlet 112 is preferably provided with an inlet vacuum valve 113 for maintaining desired internal pressure within the stationary processing vessel 110. Additionally, the stationary processing vessel 110 is further provided with a second outlet 116, preferably including a second outlet vacuum valve 117 for discharging processed solid and/or semi-solid material into, e.g., an appropriate container 148. The stationary processing vessel 110 is further provided with a first outlet 114 and a filter 120, preferably a high efficiency particle filter, for filtering particulates from the volatilized component, and discharging the filtered, volatilized component into the gas treatment system via conduit 137.

Coupled to the first outlet 114 disposed in the upper quadrant of the stationary processing vessel 110 is the heated high efficiency filter 120 (e.g., a HEPA filter). This filter 120 can be heated, for example, by surrounding it in an insulated enclosure or jacket 121 defining a space integral with the heating space 122. As such, heat from the combustion products enters this enclosure, thereby efficiently heating the filter 120 (e.g., the exterior surface of the filter). Alternatively, the surface of the filter 120 can be heated by electric resistance heaters and the surface insulated to prevent heat loss. Any method of heating the filter 120 may be used such that the surface temperature is maintained substantially above the ambient temperature, and preferably above the solids temperature within the stationary processing vessel 110. By heating the filter 120, the desorbed vapors are maintained in the gas phase as they are discharged from the stationary processing vessel 110, thereby reducing and/or substantially preventing their deposition on the filter elements or walls of the filter housing.

The filter 120 is typically regenerated at the same time as the processed solid and/or semi-solid material is discharged from the stationary processing vessel 110 through the second outlet 116 and into an appropriate container or hopper 148, by rapidly reversing the flow direction through the filter 120. This reversed flow causes the separated solids to fall from the filter elements into the interior cavity of the stationary processing vessel 110. In this way, a low gas pressure drop across the filter element is restored prior to the next treatment cycle.

The inlet 112 and the first and second outlets 114, 116 are provided with vacuum valves both to allow the passage of material as required to fill and discharge the stationary processing vessel 110, and also to seal the stationary processing vessel 110 to allow operation at strong vacuum. Vacuum valves with rotating metal discs and metal seats, such as are manufactured by Gemco Valve Company (Middlesex, N.J.), are preferred because of the high temperature imposed by the proximity of the furnace. The stationary processing vessel 110 may also be provided with a liquid injection nozzle 160 and a liquid isolation valve to allow introduction of pumpable liquids during the treatment cycle.

The mixing apparatus 150 for moving feed material disposed in the interior cavity of the stationary processing vessel 110 as depicted in FIGS. 2-4 include at least a gear motor 154, shaft bearing assemblies 129, and shaft 152. At least a portion of the shaft 152 extends horizontally along axis 125 through the stationary processing vessel 110.

Appropriate mixing elements 155 including various shaped attachment 157 are attached to the portion of the shaft 152 within the stationary processing vessel 110. For example, mixing elements 155 including plow-type attachments 157 are shown in FIGS. 3 and 4, but pug, bar, ribbon or similar mixing elements can also be used as appropriate to the feed material being treated.

The shaft 152 is rotated using a gear motor 154, preferably mounted at least partially exterior to the stationary processing vessel 110. The motor 154 is configured to rotate the shaft 152 and mixing elements 155 within the stationary processing vessel 110, causing mixing of the feed material disposed therein. The gear motor 154 is typically installed outboard of the drive end bearing and at a sufficient distance from the furnace enclosure so as to not require special design for high temperature operation.

The shaft 152 of the mixing apparatus 150 that provides mixing of the feed materials is driven by gear motor 154 and includes the plurality of mixing elements 155 attached thereto, essentially at a 90 degree angle with respect to the shaft. The mixing elements 155 further include attachments 157 that provide contact with and mixing of the feed material. A typical attachment 157 has a plow or paddle configuration.

The mixing elements 155 extend from the shaft to the wall defining the interior cavity of the stationary processing vessel 110. The mixing elements preferably extend to wall of the interior cavity such that the attachments 157 to the mixing elements 155 essentially maintain a close tolerance with the wall, without extending so far that friction created by contact impedes the movement of the mixing elements 155. On the other hand, the clearance between the wall of the interior cavity of the stationary processing vessel 110 and the mixing elements 155 is preferably small enough that a layer of solids does not form on the wall, thereby insulating the metal wall of the stationary processing vessel 110 and preventing efficient heat transfer to the feed material disposed within the stationary processing vessel 110.

In alternative embodiments, pug, bar, ribbon, etc. mixing elements can also be used as appropriate to the feed material being treated, and the mixing elements may be attached to the shaft at various angles, depending upon the feed material to be processed. Any configuration of mixing element may be used, provided it allows for agitation of the material bed to bring material in close contact with the heated wall surface, and further provides breaking up of the feed material, as needed, and promotes mass transfer and the removal of one or more volatile components from solid and/or semi-solid feed material.

Once the processed solid and/or semisolid material attains the desired characteristics, as determined, e.g., by testing of the processed material and comparison with previously treated material, attainment of a prescribed temperature of the solids bed, etc., the second outlet vacuum valve 117 is opened and the processed material is removed from the stationary processing vessel 110 via the second outlet 116 by the force of gravity depositing the processed solid and/or semi-solid material into a suitable container 148, and/or using, for example, a conveyer 162, such as a screw-type conveyer, or other similar device, to transfer the processed solid and/or semi-solid material into a suitable container, a treated material pile, etc. Additionally, water may optionally be added to the processed solid and/or semi-solid material to alter its properties, e.g., rendering the material easier to transport, rendering it less dusty, etc.

As shown in FIG. 4, the gas burner 119 providing heat to the heating space 122 is connected to the furnace enclosure 124 in FIG. 4 by directly attaching the burner to the furnace enclosure 124 and providing heat to the heating space 122 via combustion in the heating space 122. Alternatively, heat may be provided via ductwork connecting the furnace enclosure 124 and a source of heat at a location remote from the furnace enclosure. Such embodiment may be desirable, for example, to protect personnel from radiation exposure from feed material being processed in the stationary processing vessel 110.

The furnace enclosure 124 is defined by an outer wall **123*a* and an insulated inner wall 170. The stationary processing vessel 110 enclosed by the furnace enclosure 124 is defined by an outer wall 111 and an inner wall 115. The dimension of the heating space 122 is defined by the distance between the outer wall 111 of the stationary processing vessel 110 and the insulated inner wall 170 of the furnace enclosure 124**.

The mixing element 155 attached to and rotated within the stationary processing vessel 110 by movement of the shaft 152 is disposed such that a plow-type attachment 157 of the mixing element 155 is in close proximity to the inner wall 115 of the stationary processing vessel 110. Optionally, attachments 157 are configured to be at a slight angle to the arm of the mixing element 155, providing radial and axial movement of the feed material when the shaft 152 is rotated. Further, the angles of each of the attachments 157 of the plurality of mixing elements 155 may be varied, e.g., providing movement of the feed material in one direction axially, then, subsequently in another direction axially. This configuration advantageously promotes movement of the feed material throughout the stationary processing vessel 110, rather than having feed material remain near one mixing element 155.

The volatilized component is drawn by vacuum and/or carrier gas through the first outlet 114 and filter 120, entering the gas treatment system via the conduit 137. FIG. 4 (as well as FIG. 3) depicts 3 filters 120; however, as many filters as desired for a particular application, depending upon the physical constraints of the outlet 114 may be used, e.g., as many as 10 or more filters, preferably 15 or more filters, and more preferably 20 or more filters. The filters are installed in any suitable conventional manner, e.g., by installation in tubesheet plate 139.

The complete disclosures of the patents, patent documents, and publications cited herein are incorporated by reference in their entirety as if each were individually incorporated. Various modifications and alterations to this invention will become apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims set forth herein as follows.

What is claimed is:

1. A method for separating at least one volatile component from a feed material comprising the at least one volatile component, the method comprising:

introducing the feed material into an interior cavity defined in a stationary processing vessel, the stationary processing vessel disposed within a furnace enclosure, wherein a heating space is provided between an outer wall of the stationary processing vessel and the furnace enclosure;

indirectly heating the feed material in the interior cavity to volatilize the at least one volatile component without decomposing the at least one volatile component, wherein heating the feed material results in a volatilized component and processed solid and/or semi-solid material, wherein the volatilized component comprises a gaseous component, and further wherein the feed material is heated to a temperature of at least 675° F. by transferring heat from the heating space to the feed material via the outer wall of the stationary processing vessel;

filtering and discharging the volatilized component from the stationary processing vessel prior to condensing the volatilized component; and removing the processed solid and/or semi-solid material from the stationary processing vessel.

2. The method of claim 1, further comprising moving the feed material within the interior cavity of the stationary processing vessel.

3. The method of claim 1, further comprising condensing the volatilized component to provide a condensed liquid after the volatilized component is filtered.

4. The method of claim 3, wherein the condensed liquid comprises essentially no radioactive material.

5. The method of claim 1, wherein the feed material comprises material selected from the group consisting of soil contaminated with oil, soil contaminated with volatile organic material, soil contaminated with radioactive material, ion exchange resin, filter cake, sludge and sludge-type solids, trash debris, man-made debris, pumpable slurries with free liquids, radioactive liquids, and combinations thereof.

6. The method of claim 1, wherein the at least one volatile component comprises material selected from the group consisting of chlorinated solvents, aliphatic hydrocarbon solvents, aromatic hydrocarbon solvents, petroleum products, polychlorinated biphenyls, dioxin, chlorinated pesticides, chlorinated herbicides, mercury, mercury derivatives, and combinations thereof.

7. The method of claim 1, wherein the feed material comprises a radioactive material.

8. A method for separating at least one volatile component from a feed material comprising the at least one volatile component, the method comprising:

introducing the feed material into an interior cavity defined in a stationary processing vessel, the stationary processing vessel disposed within a furnace enclosure, wherein a heating space is provided between an outer wall of the stationary processing vessel and the furnace enclosure;

heating the feed material in the interior cavity to volatilize the at least one volatile component without decomposing the at least one volatile component, wherein heating the feed material results in a volatilized component and processed solid and/or semi-solid material, wherein the volatilized component comprises a gaseous component, and further wherein the feed material is heated to a temperature of at least 675° F.;

filtering and discharging the volatilized component from the stationary processing vessel, wherein filtering the volatilized component comprises providing a filter for use in filtering a gas stream including the volatilized component and heating the filter; and removing the processed solid and/or semi-solid material from the stationary processing vessel.

9. The method of claim 1, wherein filtering the volatilized component comprises using a filter operable to filter particulates having a size of about 40 μm or less.

10. The method of claim 9, wherein the filter is operable to filter particulates having a size of about 1 μm or less.

11. The method of claim 1, wherein the feed material is heated to a temperature of at least 925° F.

12. The method of claim 1, wherein the method is performed semi-continuously.

13. The method of claim 1, wherein heating the feed material comprises controlling the temperature in the heating space using one or more gas burners.

14. The method of claim 1, wherein heating the feed material comprises controlling the temperature in the heating space using one or more oil fired burners.

15. The method of claim 1, wherein the feed material comprises one or more of a radioactive solid material, an ion exchange resin, and a trash debris, and wherein the processed solid and/or semi-solid material is subsequently processed in a glass melter vitrification unit.

16. The method of claim 8, further comprising moving the feed material within the interior cavity of the stationary processing vessel.

17. The method of claim 8, further comprising condensing the volatilized component to provide a condensed liquid after the volatilized component is filtered.

18. The method of claim 17, wherein the condensed liquid comprises essentially no radioactive material.

19. The method of claim 8, wherein the feed material comprises material selected from the group consisting of soil contaminated with oil, soil contaminated with volatile organic material, soil contaminated with radioactive material, ion exchange resin, filter cake, sludge and sludge-type solids, trash debris, man-made debris, pumpable slurries with free liquids, radioactive liquids, and combinations thereof.

20. The method of claim 8, wherein the at least one volatile component comprises material selected from the group consisting of chlorinated solvents, aliphatic hydrocarbon solvents, aromatic hydrocarbon solvents, petroleum products, polychlorinated biphenyls, dioxin, chlorinated pesticides, chlorinated herbicides, mercury, mercury derivatives, and combinations thereof.

21. The method of claim 8, wherein the feed material comprises a radioactive material.

22. The method of claim 8, wherein filtering the volatilized component comprises using a filter operable to filter particulates having a size of about 40 μm or less.

23. The method of claim 22, wherein the filter is operable to filter particulates having a size of about 1 μm or less.

24. The method of claim 8, wherein the feed material is heated to a temperature of at least 925° F.

25. The method of claim 8, wherein the method is performed semi-continuously.

26. The method of claim 8, wherein heating the feed material comprises controlling the temperature in the heating space using one or more gas burners.

27. The method of claim 8, wherein heating the feed material comprises controlling the temperature in the heating space using one or more oil fired burners.

28. The method of claim 8, wherein the feed material comprises one or more of a radioactive solid material, an ion exchange resin, and a trash debris, and wherein the processed solid and/or semi-solid material is subsequently processed in a glass melter vitrification unit.

* * * * *